United States Patent [19]

Brakel

[11] 4,149,480

[45] Apr. 17, 1979

[54] HOPPER BARGE

[75] Inventor: Joost Brakel, Schiedam, Netherlands

[73] Assignee: Adriaan Volker Baggermaatschappij B.V., Rotterdam, Netherlands

[21] Appl. No.: 835,910

[22] Filed: Sep. 23, 1977

[30] Foreign Application Priority Data

Jul. 29, 1977 [NL] Netherlands ..... 7708449

[51] Int. Cl.[2] ..... B63B 27/00

[52] U.S. Cl. ..... 114/26; 414/142; 414/786

[58] Field of Search ..... 37/54, 56; 114/26–28, 114/36–37; 137/576; 210/242 R, 242 S; 214/15 B, 152

[56] References Cited

U.S. PATENT DOCUMENTS

| | | | |
|---|---|---|---|
| 1,150,981 | 8/1915 | Walter | 114/26 |
| 3,630,400 | 12/1971 | De Koning | 214/15 B X |
| 3,944,489 | 3/1976 | Derzhavets et al. | 210/242 R |

FOREIGN PATENT DOCUMENTS

| | | | |
|---|---|---|---|
| 7509746 | 2/1977 | Netherlands | 114/26 |

*Primary Examiner*—Stephen G. Kunin

[57] ABSTRACT

A barge for receiving dredged materials and water comprising a hull defining a hold and overflow apparatus for discharging excess water from the hold; the overflow apparatus comprises a separate discharge passage having a discharge outlet below the water line of the barge, a port defining an overflow opening communicating the hull and the discharge passage at a fixed position above the predetermined level to which solids are to be collected in the hold and below the predetermined levels of water in the hold and in the discharge passage, and a control valve in the discharge outlet for regulating the water level in the discharge passage. The method of dredging comprises maintaining the water level as aforesaid to prevent aeration of overflowing water.

4 Claims, 1 Drawing Figure

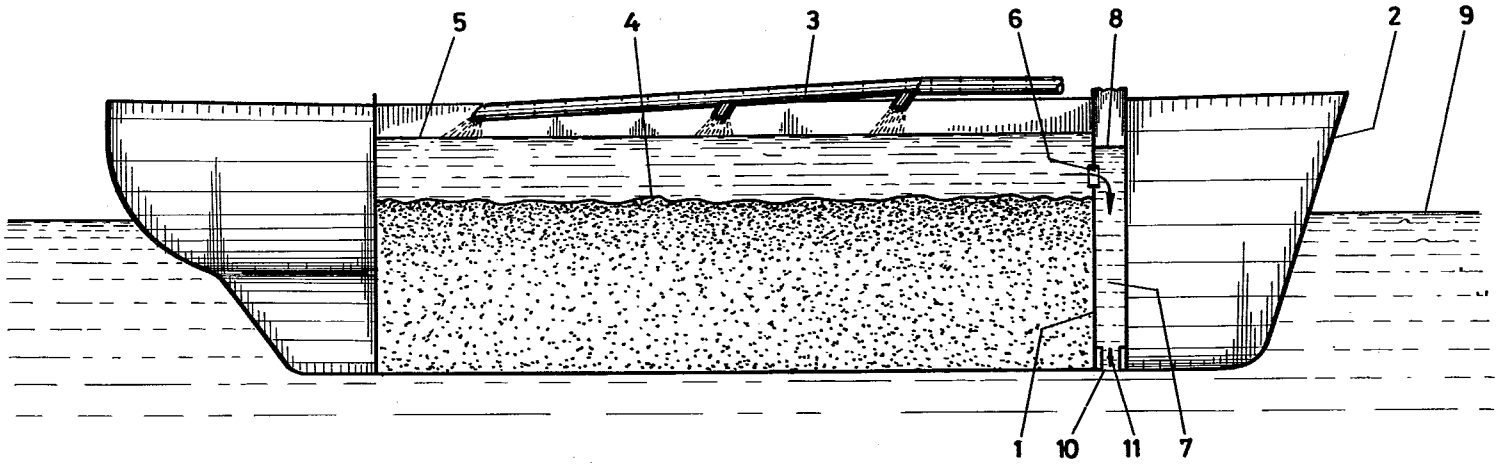
9
2
8
6
3
4
5
7
11
10
1

HOPPER BARGE

The invention relates to a hopper barge of a suction dredge or barge with an overflow brim and to a method of dredging to avoid aeration of overflowing water.

Such barges are known. There, discharge of excess water is realized directly into the surrounding water or into a separate space via the overflow brim. During this overflow, aeration takes place. The overflowing water contains fine sand or clay particles. Due to the air carried along, the particles in the water discharged via the overflow brim are either prevented from settling or else their settling is slowed down, as a result of which the water round the hopper barge will become muddy.

It is observed that, from the Dutch Pat. application No. 75.09746 laid out for public inspection, a method is known in which the overflow takes place in a separate space, in which the water covers a long distance to allow the air to escape. However, the air is still admitted during the overflow and this method does not entirely solve the problem.

Accordingly, it is a principal object of this invention to prevent aeration of the discharged water during overflow from the barge and to thus accelerate the settling of particulates in the water.

In general, the invention features a barge having a hull defining a hold and overflow means comprising at least one wall defining a separate passage. An overflow opening at a fixed position above the level to which solids are to be collected in the hold communicates the hold and the passage. A flow restricted discharge opening below the waterline of the barge communicates the passage through the hull of the barge. The invention also features the method in which the water level in the passage is maintained at or above the level of the overflow opening to permit a flow of water from the hull to the passage and through the discharge outlet without aeration.

In preferred embodiments, the discharge outlet includes a control valve for varying the outlet restriction to regulate water level in the passage. Also, in preferred embodiments, the overflow opening comprises a port below the predetermined levels of water in the hold and in the passage during dredging; the control valve is set to maintain the water levels above the port.

Other objects, features and advantages of this invention will be apparent to those skilled in the art from the following detailed description of a preferred embodiment thereof taken together with the accompanying drawing which illustrates, somewhat schematically, a cross-sectional view of a barge according to the invention.

The drawing shows the wall 1 of a hopper or hold defined by the hull of a barge 2. Via the supply pipe 3, a mixture of sand and water is discharged into the barge, as a result of which a rising sand level 4 and a water level 5 will form therein. The barge has vertically oriented overflow openings or ports 6 at fixed positions above the level to which the sand 4 is to be collected debouching into a passage 7 defined by wall 1 adjacent the hold in which an artificially maintained water level 8 has such a height that the overflow openings 6 will be below. In the hold itself, the water level 5 will then be equal to that in the passage 7 or higher.

Discharge from the passage 7 takes place through a restricted discharge opening 10 at a level lower than the surrounding water 9, i.e. the water line when the barge is empty.

For the control of the discharge from the passage 7, a control valve 11 is fitted near the discharge outlet 10, by means of which the water level 8 in the passage 7 is likewise regulated to be maintained above the overflow openings 6.

Advantageously, the flow of water from the hold to the overflow outlets and through the discharge outlet is isolated from the air thus preventing aeration of the overflow and thus facilitating the settling of particulates in the discharged water.

Other embodiments of this invention will occur to those skilled in the art which are within the scope of the following claims.

What is claimed is:

1. A barge for dredging comprising a hull defining a hold for receiving solids and water from dredging and further comprising overflow means for discharging excess water from the hold, characterized in that said overflow means comprises at least one wall defining a separate passage adjacent said hold extending from below the waterline of said barge to a position above the predetermined level of water in said hold during dredging, at least one generally vertical overflow opening comprising a port in said wall at a fixed position above the predetermined level to which solids are to be collected in said hold and below the predetermined level of water in said hold during dredging communicating said passage and said hold, said passage extending above said port, and a flow restricted discharge outlet in said passage below the waterline of said barge communicating said passage through the hull of said barge, whereby a water level may be maintained in said passage above said port to permit the flow of water from said hold through said port to said passage and through said discharge outlet to surrounding water without aeration.

2. The barge claimed in claim 1 further characterized in that said discharge outlet includes a control valve for varying the flow restriction of said discharge outlet to regulate the water level in said discharge passage.

3. The method of discharging water overflow from a barge during dredging comprising providing a separate passage adjacent the hold of a barge with an overflow opening comprising a generally vertically disposed port at a fixed position above the level to which solids are to be collected in the hold and below the predetermined level to which water will be collected in the hold and said passage extending from above said port to a discharge outlet below the barge waterline, filling the hold of the barge with water above said port and flowing water through said overflow port into the passage and from the passage through the discharge outlet, and maintaining a water level in said passage at least as high as the overflow port.

4. The method claimed in claim 3 further comprising maintaining said water level in said passage above said overflow port.

* * * * *